United States Patent [19]

McLaughlin

[11] 3,941,272

[45] Mar. 2, 1976

[54] CRYOGENIC TRANSPORT

[75] Inventor: Hollis G. McLaughlin, Walnut Creek, Calif.

[73] Assignee: Kaiser Aluminum & Chemical Corporation, Oakland, Calif.

[22] Filed: Mar. 27, 1974

[21] Appl. No.: 455,445

[52] U.S. Cl. ..... 220/9 LG; 62/45; 62/240; 114/74 A; 220/15

[51] Int. Cl.[2] ..... B65D 25/18

[58] Field of Search ..... 62/45, 240; 114/74 A; 220/9 LG, 15; 29/196.2; 161/38

[56] References Cited

UNITED STATES PATENTS

| | | | |
|---|---|---|---|
| 2,959,318 | 11/1960 | Clark et al. | 220/15 |
| 3,062,397 | 11/1962 | Bergmann | 220/15 |
| 3,083,668 | 4/1963 | Marciano | 114/74 A |
| 3,101,861 | 8/1963 | Mearns et al. | 220/9 LG X |
| 3,298,345 | 1/1967 | Pratt | 114/74 A |
| 3,319,430 | 5/1967 | Small | 62/45 |
| 3,319,431 | 5/1967 | Clarke et al. | 62/45 |
| 3,420,396 | 1/1969 | Bridges et al. | 220/9 LG |
| 3,502,239 | 3/1970 | Worboys et al. | 220/9 LG |
| 3,664,816 | 5/1972 | Finnegan | 29/196.2 |
| 3,669,816 | 6/1972 | Smith et al. | 161/38 |
| 3,724,703 | 4/1973 | Yamamoto | 220/9 LG |
| 3,757,982 | 9/1973 | Isenberg et al. | 220/9 LG X |

FOREIGN PATENTS OR APPLICATIONS

| | | |
|---|---|---|
| 818,835 | 8/1959 | United Kingdom |

OTHER PUBLICATIONS

Razdui et al., Welding Structures of Steel and Aluminum With Aids of Inserts of Clad Metal; Welding Production, Vol. 13, No. 1, Jan. 1966.

Thomas, LNG Carriers: The Current State of the Art, Pub.: Society of Naval Architects and Marine Engineers, Nov., 1971.

*Primary Examiner*—William F. O'Dea
*Assistant Examiner*—Ronald C. Capossela
*Attorney, Agent, or Firm*—Paul E. Calrow; John S. Rhoades

[57] ABSTRACT

Improved system for mounting an aluminum cryogenic liquid holding tank within and integrating such tank to an outer ferrous metal envelope or hull structure wherein improved composite aluminum-ferrous metal transition insert elements are employed to interconnect the exterior surfaces of the aluminum tank to the interior surfaces of the ferrous metal envelope or hull structure.

23 Claims, 9 Drawing Figures

CRYOGENIC TRANSPORT

BACKGROUND OF THE INVENTION

This invention relates to the transportation and/or storage of liquified and/or compressed gases in bulk cargo tanks and the like. More particularly, it is concerned with an improved system for mounting a cryogenic liquid holding tank of aluminum metal construction within and integrating such tank with an outer envelope or supporting hull structure of ferrous metal.

Thoughout the world today there is an ever increasing need and demand for natural gas as well as inexpensive and efficient means for storing and transporting this gas in the form of liquified natural gas (LNG) from one location to another. During such transport in the liquid state, the natural gas is generally held at a temperature of about −260°F. at approximately atmospheric pressure.

The relatively low temperatures at which liquified gases, such as liquified natural gases, must be kept during transport in combination with the varied stresses to which the transport tanks themselves are subjected during movement have posed numerous problems to the tank builder.

For example, severe static stresses are imposed on shipboard tanks due to the extreme temperature variations that occur in the tank during loading and unloading. Severe dynamic stresses are set up in the shipboard tank structures due to the liquid cargo accelerations and the sloshing of the liquid cargo in the tanks during ocean transport as well as from the deflections and bending of the transport vessel itself when moving through heavy seas. Thus, in contrast to situations where simple, conventional, shore-based tank support systems might be used for on-shore storage and transport, marine transport systems for liquified gases had to be substantially altered in order to withstand the numerous and varied severe stresses imposed upon a vessel and its cryogenic cargo tanks during an ocean voyage or the like.

At the present time, there are four principal tank containment systems used on cryogenic transport vessels. They are commonly referred to as "prismatic free-standing tanks," "spherical free-standing tanks," "semi-membrane tanks," and "membrane tanks." These various tank structures and the vessels in which such tank structures are incorporated as well as the individual merits of each are described in considerable detail in a paper which was presented by William Du-Barry Thomas et al to the Society of Naval Architects and Marine Engineers on Nov. 11–12, 1971, and the title of this paper is "LNG Carriers - The Current State of the Art."

When the containers or tanks for certain of these systems are made of metal adapted to be in direct contact with the cryogenic liquid, they have to be formed from materials which are not subject to brittleness failure at low temperatures, such as, for example, aluminum, stainless steel or 9 nickel steel. Aluminum has been preferred because of its cost and the steel ordinarily used in tank construction has not been used because of its susceptibility to embrittlement at the very low liquified gas holding temperatures.

When any of the four above-noted containment systems were installed on a vessel, a complicated arrangement has been provided for appropriately insulating and isolating the tank from the ship's hull or bulkhead lest the low temperature cryogenic liquid possibly crack or embrittle the customary steel plates of the basic hull structure of the vessel. Various types of insulating materials, such as perlite, PVC foam, polyurethane foam, fiberglass or various combinations thereof have been used either to line the inner walls of the cryogenic tanks or for emplacement between the upstanding inner cryogenic tank walls and the bulkheads of the inner hull in order to thermally isolate the cryogenic tank from the hull structure. These expedients have been costly and have not always made the most efficient application of the materials used.

SUMMARY OF THE INVENTION

The present invention is directed to an improved system forr integrating and joining an aluminum tank for holding a cryogenic liquid, such as liquified natural gas, with the steel or ferrous metal hull of a tanker vessel in such a way as to make the cryogenic tank and steel hull of the vessel work as a composite structure in withstanding the various static and dynamic stresses such a vessel as well as the cargo tank itself is subjected to during normal use without at the same time exposing the steel or ferrous metal of the vessel's hull to the direct action of the cryogenic liquid whereby it would become embrittled because of the low cryogen ic temperatures.

In one embodiment of the invention, a corrugated cryogenic aluminum tank wall construction is used along with internal tank insulation. This arrangement minimizes the large expansions and contractions of the tank usually associated with the substantial temperature differences or thermal cycling experienced with the filling, transporting and offloading of cryogenic liquid cargos. The use of internal insulation permits attachment and integration of the cryogenic tank directly to the steel hull structure of the vessel such that improved horizontal and vertical stiffeners or scantling elements may be utilized to tie the tank directly to the ship's steel hull thus taking full advantage of the high strength afforded by the steel components of the ship's hull structure.

Improved composite aluminum-ferrous metal stiffener elements are utilized to integrate the cryogenic tank with the steel hull of the vessel. These stiffeners can be in the form of the transition inserts of the type described in U.S. Pat. No. 3,664,816, issued May 23, 1972. The aluminum portion of the transition insert is joined in an improved fashion to the aluminum tank structure and the ferrous metal portion of the insert is joined in an improved fashion to the steel hull section of the vessel. Although composite aluminum-ferrous metal transition inserts have been proposed for use in securing the steel support skirt of a spherical free standing tank to an aluminum support skirt of the type shown in U.S. Pat. No. 3,680,323 issued Aug. 1, 1972, as well as for joining a ship's superstructure to the ship's deck as noted in an article in "Welding Production," Vol. 13, No. 1 of January, 1966, entitled "Welding Structures of Steel and Aluminum with the Aid of Inserts of Clad Metal" by Razdui et al, none of the aforesaid proposals contemplate the instant system for anchoring an inner cryogenic tank structure of aluminum to a ferrous metal hull in such a way as to fully integrate the tank and hull into a composite stress resistant unit while at the same time effectively thermally isolating hull and tank.

Because of the novel interconnection of tank and hull, a considerable amount of ancillary or auxiliary supporting structures together with the incident weight are avoided without any material sacrifice in the high strength characteristics of the steel hull. This same connection allows for economy and flexibility in tank manufacture and the containment tanks as made from aluminum can be fabricated independently of the hull structure and then lifted into place and finally attached to the ship hull.

As indicated in the aforementioned U.S. Pat. No. 3,664,816, the transition insert sandwich structure generally includes an aluminum alloy element and an appropriate steel element such as one made of stainless steel, both of which are pressure welded or bonded to an intermediate aluminous bonding element made from a soft aluminum alloy characterized by being more deformable than either the main steel or aluminum alloy part of the overall transition element. An aluminum alloy suitable for this purpose can be an 1100 aluminum alloy, which is the designation of the American Aluminum Association for an aluminum alloy consisting of at least 99 percent aluminum and not more than 1 percent other elements.

By utilizing the improved composite aluminum-ferrous metal, horizontal and vertical stiffener and bracing elements as the medium for joining and integrating the inner cryogenic aluminum tank to the steel hull or as the "scantlings" of a vessel's hull structure, the steel hull will be sufficiently thermally isolated from the aluminum tank to preclude the low temperature liquified natural gas from coming into dangerous embrittling contact therewith and while the hull is still joined to the tank in reinforcing relationship.

In an advantageous embodiment of the invention, openings in the composite longitudinal and horizontal stiffeners as well as the composite transverse bulk head sections of the vessel can be used to enable air in the closed air space between the outer hull and the inner tank to set up convection currents and fans may be used to enhance the circulation of the air in such space.

In the case of where the air is so circulated, this air as well as the overall honeycomb-like metal structure between the outer steel hull and inner aluminum tank helps to provide for a heat dissipating and temperature equalizing radiator system and for the regulation and maintenance of a substantially uniform and balanced temperature throughout the space between the inner tank and adjacent hull that still prevents the steel of the hull from being adversely affected by the cold temperature of the liquified and/or compressed gas cargo.

DETAILED DESCRIPTION

Figure 1:
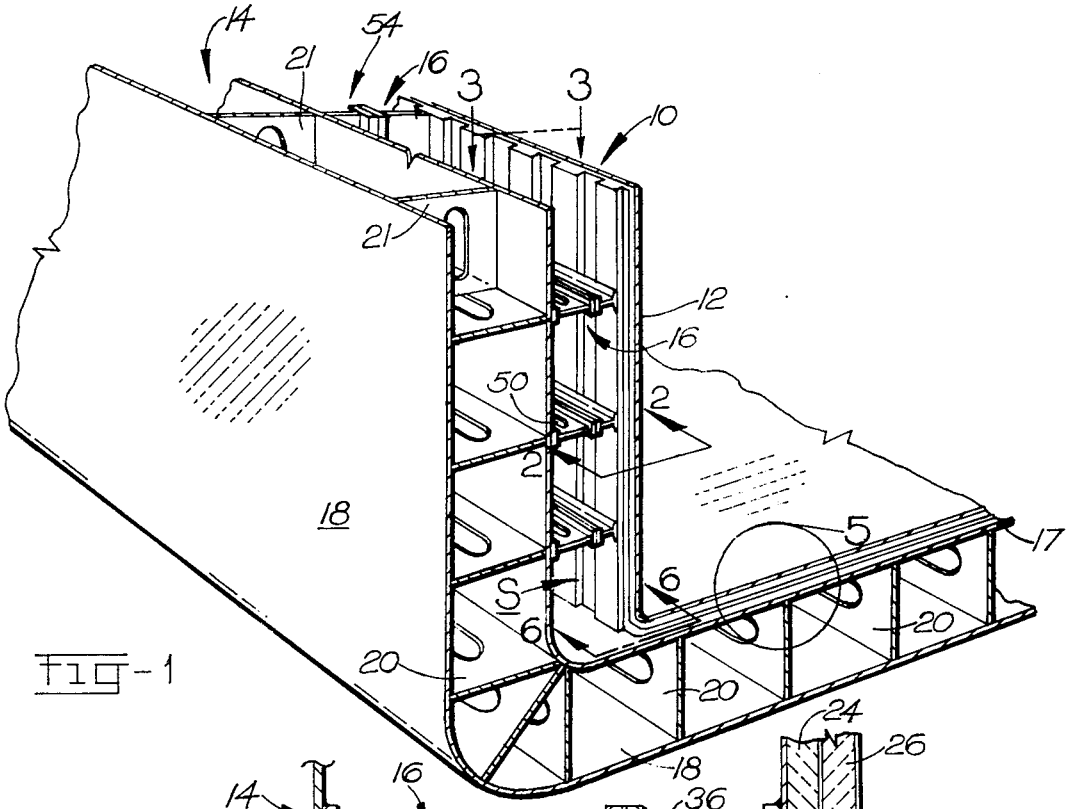
FIG. 1 is a fragmentary perspective view of a double-hulled vessel in which a membrane-type cryogenic tank is supported within the hull structure in accordance with the teachings of the instant invention.

Although the teachings of the instant invention are applicable to a stationary land-based cryogenic tank structure as well as marine transport structures, they will be described with particular application to marine transport. With further reference to the drawings and, in particular, FIG. 1, the instant invention is particularly useful with a membrane-type tank system comprised of an overall aluminum cryogenic tank structure 10 coated or covered on the inside with appropriate cryogenic insulation 12. The aluminum tank structure is ultimately attached to and supported by and integrated with the ship's hull structure 14 by means of the composite transition insert support, reinforcing and stiffening elements 16. In the case of where hull structure 14 comprises both an inner or primary hull 17 and a secondary or outer hull 18, the outer hull is appropriately connected to the inner hull 17 by the usual scantling elements, such as perforated stringers 20 and transverse bulkheads 21.

Figure 2:
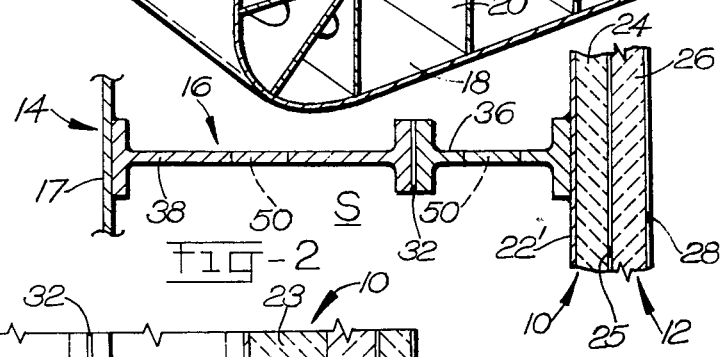
FIG. 2 is a sectional view generally taken along the line 2—2 of FIG. 1 and shows one form of transition aluminum-steel insert that can be used to integrate the cryogenic tank with the vessel's hull, and with a flat wall section being used.

In a preferred embodiment of the invention, the sidewall of the aluminum tank structure 10 or the portion of the wall structure that is subjected to the most exacting loading is comprised of corrugated aluminum wall sections 22 made out of a suitable aluminum alloy of the appropriate thickness, pitch and depth instead of the flat aluminum sheet 22' of FIG. 2. The corrugated sections can be flat topped corrugations and individual sections can be appropriately overlapped at their terminal edges by the edges of adjacent corrugation sections in a manner well known in the art.

Disposed in the pockets of the corrugated sections 22 that open inwardly towards the inner section of the cryogenic tank that is exposed to the cryogenic liquids are preformed polyurethane foam blocks 23 of a relatively rigid construction, appropriate density and closed cell structure. The blocks 23 are adhesively bonded to the aluminum and in some instances it may be desirable to apply an appropriate primer to the aluminum corrugated sections to clean the metal so as to provide good adhesion between the foam blocks and the metal surfaces of sections 22. Superimposed upon the secured to blocks 23 and to the exposed flat tops 23' of sections 22 or to sheets 22' when such sheets 22' are used is cryogenic insulation 12 which can take the form of one or more layers of polyurethane foam, fiberglass, perlite, PVC foam or various combinations thereof applied in a manner well known in the art.

In an advantageous embodiment of the invention this further interior cryogenic insulation of the tank can be of the same general type that is disclosed in copending application Ser. No. 378,138 of Herbert H. Borup, filed July 11, 1973, or it can comprise the interior type insulating system disclosed in U.S. Pat. No. 3,757,982 issued Sept. 11, 1973. As indicated in the aforesaid copending patent application of Herbert H. Borup, the insulation 12 can include alternate layers of cryogenic polyurethane foam and impermeable aluminum foil with the aluminum foil acting as the primary and secondary containment barriers designed and required as safety factors by various regulatory agencies, such as the United States Coast Guard, to insure that the cryogenic liquid, such as liquified natural gas, does not come into contact with the ship's hull or bulkheads whereby it would crack and embrittle the same.

These alternate insulation layers can comprise a primary layer 24 of relatively rigid and closed cell polyurethane foam of the proper density which can be built up to the appropriate thickness by means of the customary spray, pour or froth techniques. Superimposed upon and appropriately bonded to layer 24 is a first membrane of aluminum boil 25 that is impermeable to the low temperature liquid in the tank 10 and the vapors liberated therefrom followed by a further polyurethane foam layer 26 which can be applied in the same fashion and be of the same composition, etc. as layer 24 although it is not quite as thick. Thereafter, superimposed and attached to the final layer 26 of foam is a further final membrane of aluminum foil 28 which acts as the primary liquid barrier and the interior membrane wall structure which is in direct contact with the low temperature liquified gas cargo of the tank.

Since the aluminum foil membrane 28 which constitutes an impervious layer has a lower coefficient of expansion that the foam and at the same time a higher strength than the foam, it will maintain its ductility at cryogenic temperatures. The foil can be plain or embossed and of appropriate thicknesses and temper. Preferably, it should have a tensile strength of at least about 5000 psi and an elongation of at least 10 percent in 2 inches at cryogenic temperatures. This overall insulation made up of alternate layers of foam and foil acts as an efficient inner tank structure preventing the intrusion of LNG and also serves as stopping points or barriers in the event of cracks in the foam. Such a tank structure is capable of holding the liquids at various cryogenic temperatures on the order of anywhere from −50° to −400°F. at atmospheric pressure even though the liquified gases are generally maintained at about −260°F. in their liquid state during transport.

Figure 4:
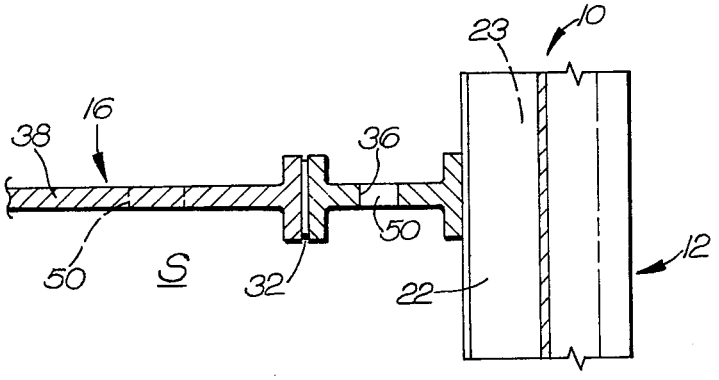
FIG. 4 is a sectional view generally taken along the line 4—4 of FIG. 3.

The top of the tank can be fabricated in the same general fashion as shown in the prior copending patent application of Herbert H. Borup or prior U.S. Pat. No. 3,757,982, all in a conventional manner. Corrugated sections 22 are welded or otherwise affixed to an aluminum skin transition element 16 in the manner shown in FIG. 4 while the aluminum bottom decking 29 of the tank 10 is anchored to and integrated with the inner steel hull 17 through the medium of the transition elements 16'. At the bottom corners of the tank where the bottom and side walls meet, it is possible to install or inject an additional block of polyurethene foam 30 similar to foam layers 24 and 26 which can likewise be sprayed on and foam 30 serves as a support for the previously described layers 24 and 26 in the area of a tank corner. A further transition element 16'' sandwiched in between and appropriately welded to the aluminum sheet bottom 29 and sections 22 is used to attach the tank 10 to the inner hull 17 in the corner areas of the tank.

As indicated in U.S. Pat. No. 3,664,816, a transition element 16, 16' or 16'' can be generally comprised of an aluminous bonding element of an appropriate soft aluminum alloy 32 that is sandwiched in between and then pressure welded to a harder aluminum alloy element 36 and a steel element 38 which preferably is made of stainless steel. Aluminum element 36 may be made in the form of an extruded I-beam as noted in FIGS. 2 and 4 extruded and cut to the proper size and then welded by way of its free flange to a corrugated section 22 or a flat sheet of aluminum 22' making up a wall of tank 10. Ferrous metal section 38 can comprise a stainless steel I-beam, the free flange of which is anchored to the steel hull 17.

Figure 6:
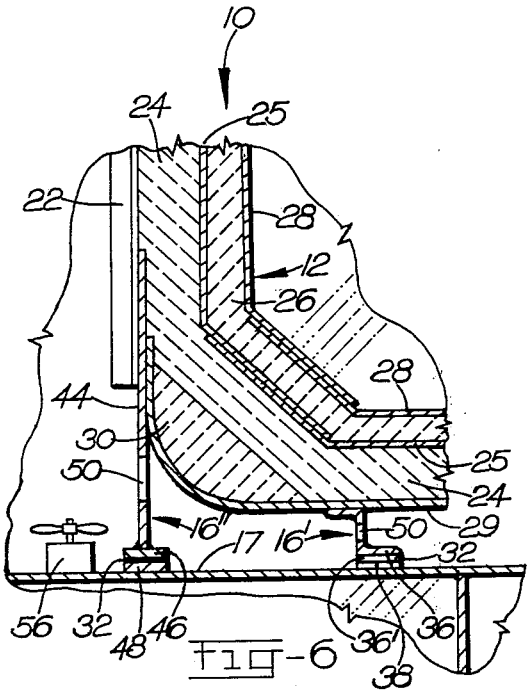
FIG. 6 is a view generally taken along the line 6—6 of FIG. 1 and with parts added.
Figure 7:
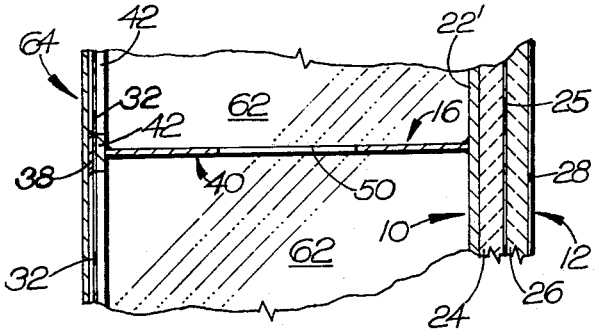
FIG. 7 is a view taken within the circumscribing line 7 of FIG. 9 and shows a modified form of transition insert which can be used particularly with the hull structure of FIGS. 8 and 9.

In other instances, the aluminum element 36 can be made in the form of a forging, a T-beam, extrusion or a Z-shaped foot element as in the case of the transition insert element of FIG. 6 and arc welded to a flat aluminum insert 36' that is directly pressure welded to the soft aluminum insert 32. As illustrated in FIG. 7, a modified form of transition element 16 can comprise a flat section of aluminum plate 40 arc welded to a runner 42 of relatively hard aluminum, e.g. the 7039 aluminum alloy of U.S. Pat. No. 3,664,816 which, in turn, along with a stainless steel runner or stringer 38 is pressure welded to the soft aluminum insert 32. The free end of aluminum plate 40 is arc welded to the aluminum tank wall 22' while the steel runner 38 is then welded to the steel hull 17. In the case of the composite transition element of FIG. 7, the aluminum extends for the major part of the space between hull 17 and tank 10 and thus is particularly useful in fabricating the double hulled cryogenic cargo barge structure of FIGS. 8 and 9 to be subsequently described.

As indicated in FIG. 6, a transition element 16'' somewhat similar to that of FIG. 7 can be used to secure and integrate the aluminum tank structure 10 to the inner steel hull in the corner or bilge area. Transition element 16'' includes an aluminum support plate 44 welded to an aluminum stringer foot 46 which along with a steel, e.g. stainless steel, stringer foot 48 is pressure welded to the soft aluminum transition insert 32. The steel stringer 48 is welded directly to the inner steel hull 17 at the bottom of the tank while plate stringer 44 is welded both to the aluminum sheet bottom 29 and corrugated sections 22 and partly immersed in the section 24 of insulation 12 as noted.

In a further advantageous embodiment of the invention, it will be noted that the different transition stringers of stainless steel and aluminum can be provided with perforations 50. The standard transverse webbing or bulkhead elements 54 between the inner hull 17 and the aluminum tank structure 10 can likewise take the form of the composite transition elements 16 previously described and can likewise be perforated so as to provide for air circulation through the sealed space S between the aluminum tank structure 10 and the hull 17. By providing such openings in the longitudinal transitional inserts 16 as well as in the transitional transverse bulkheads 54 along with strategically located fans 56 one of which is shown in FIG. 6 and/or openings in the top of the space S adjacent the vessel's superstructure, controlled air flow can be set up in the closed air space S between hull 17 and the inner tank 10. This controlled flow of air in combination with the overall honeycome-like metal structure defined by the longitudinal transitional insert stringers 16, 16' and 16'' and the transitional transverse bulkheads 54 advantageously produce an overall heat dissipating and temperature equalizing radiator system. The result is that a substantially uniform and balanced temperature can be maintained throughout the space S between the inner hull 17 and the aluminum tank structure 10 so that the steel of the hull 17 as well as the steel of the composite transition elements 16 will remain relatively unaffected by the cold temperatures of the liquified gas cargo. In short, the use of the system of the instant invention will enable a sufficient temperature rise to take place in the aluminum components of the composite transition insert elements to allow the steel of such elements to be exposed to higher metal temperatures than would ordinarily prevail if the steel was in direct contact with the cryogenic liquid. This is particularly true in the case of the stringer aluminum plate 40 of FIG. 7 which extends for at least the major or almost substantially the entire space or gap between the aluminum tank structure 10 and the hull 17.

Figure 8:
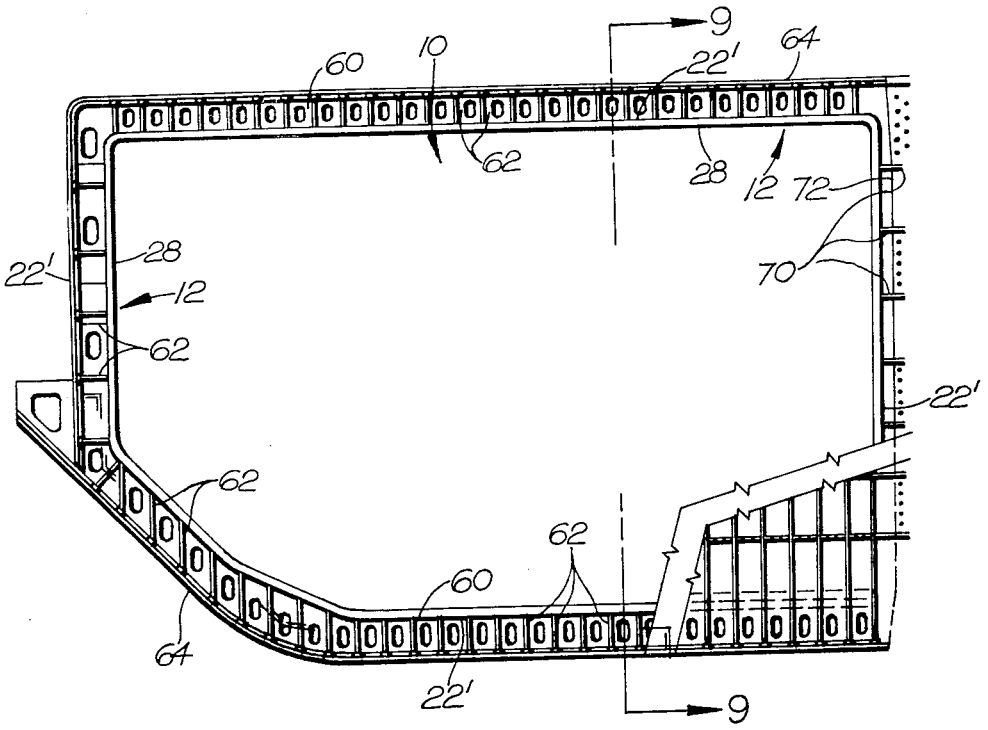
FIG. 8 is a partial longitudinal sectional and partly schematic view of a cryogenic double-hulled barge structure that can be fabricated in accordance with the instant invention.
Figure 9:
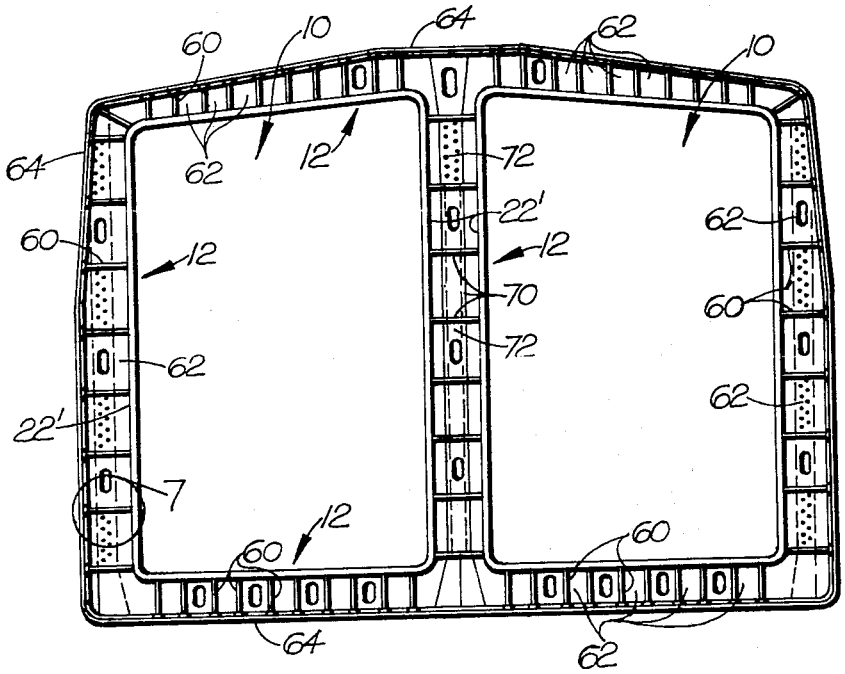
FIG. 9 is a transverse view of the barge structure of FIG. 8 when taken along the line 9—9 of FIG. 8 with parts added.

The instant anchoring and integration system is useful in either the vessel construction of FIG. 1 which employs two hulls 17 and 18 of steel in addition to an inner cryogenic tank 10 or the transport vessel or barge of FIGS. 8 and 9 used to transport liquified natural gas wherein only a single hull is used in addition to one or more inner aluminum cryogenic cargo tanks 10. In this barge construction, the insulation 12 and aluminum tanks 10 and supports could be comprised of the basic structures shown in FIGS. 6 and 7 with composite perforate transition elements 16 being used as longitudinal stringers 60 and traverse bulkheads 62 to interconnect the outer steel hull structure 64 with the inner aluminum sheets 22' and 29 of a tank 10.

In a preferred embodiment of the invention, the various longitudinal stringers 60 and transverse bulkheads 62 are made in the form of the transition framing elements of FIG. 7, perforated for reasons previously noted with their inner ends being arc welded to the aluminum side sheeting 22' or bottom sheeting 29 of a tank 10 and their outer ends being shaped as a foot flange or welded to a further aluminum element to form such a flange 42. In such cases, the foot flange 42 is then pressure welded along with the steel, e.g. stainless steel runner 38 to the soft aluminum alloy insert 32 and with runner 38 finally being arc welded to the steel plates making up the outer hull structure 64. It is to be further understood that the stringers 60 and bulkheads 62 will be of the appropriate lengths and thicknesses and they can be welded to each other at their points of intersection and joinder in accordance with customary practices.

Figure 3:
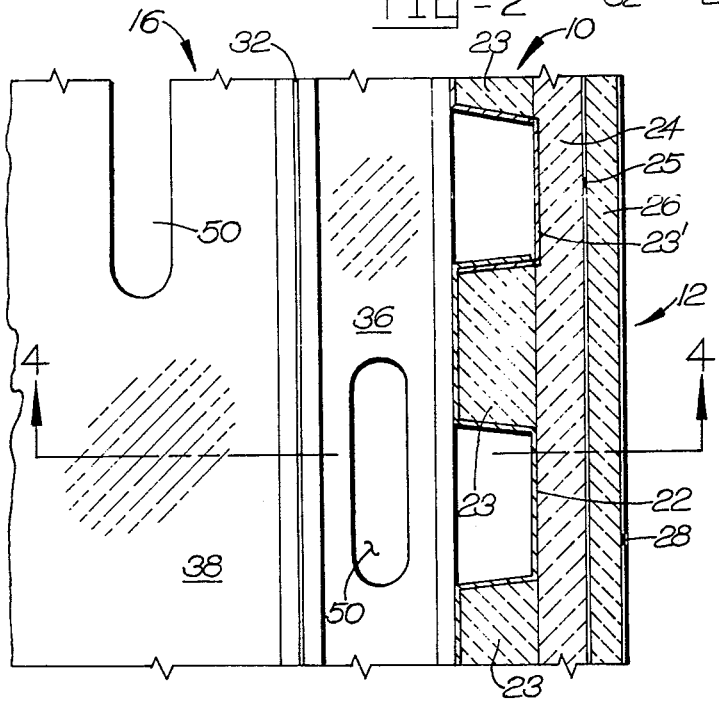
FIG. 3 is a fragmentary sectional view generally taken along the line 3—3 of FIG. 1.
Figure 5:
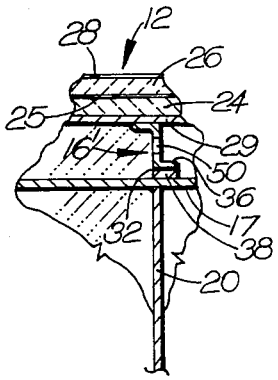
FIG. 5 is a sectional view of the bottom of the tank and generally taken within the circumscribing line 5 of FIG. 1.

In the case of where the barge structure comprises several individual tanks 10, these tanks can be interiorly interconnected with each other by heavy aluminum plate elements making up standard longitudinal stringers 70 and transverse bulkheads 72 welded to each other and at appropriate points to the various individual tanks in the customary fashion to form a rugged interconnection between the tanks 10 and the remainder of the barge structure. The result is a transport vessel or barge structure wherein the tanks 10 and outer steel hull are fully integrated yet sufficiently thermally isolated from each other to preclude embrittlement of the steel hull and with the hull structure reinforcing the aluminum tank structures in an improved fashion. Although the barge structure of FIGS. 8 and 9 has been described with particular reference to the use of the transition connector elements of FIG. 7 and with a wall structure that merely employs an aluminum metal skin 22', it is to be understood that the aluminum tank structure 10 of the barge could comprise the wall structures of FIGS. 2 and 3 with the hull 64 being substituted for inner hull 17 and the bottom tank structure of FIGS. 5 and 6 being utilized to the extent required.

An advantageous embodiment of the invention has been shown and described. It is obvious that many changes can be made therein without departing from the spirit and scope thereof as defined by the appended claims wherein:

What is claimed is:

1. A system for anchoring a cryogenic liquid holding tank of aluminum metal construction to and integrating such tank with an outer envelope-like supporting structure of ferrous metal comprising the combination of an aluminum cryogenic liquid holding tank, cryogenic insulation secured to the interior metal surfaces of the cryogenic liquid holding tank, a ferrous metal envelope-like supporting structure encompassing in spaced relation at least the major outer surface portions of the cryogenic liquid holding tank and transition connector means anchoring the aluminum cryogenic liquid holding tank to and fully integrating the said tank with the ferrous metal envelope-like supporting structure to form a composite stress resistant unit, said transition connector means including bonded together composite aluminum and ferrous metal transition stringer inserts interposed between the tank and said supporting structure the aluminum portion of an insert being directly and rigidly connected to the outer surfaces of the aluminum cryogenic liquid holding tank while the ferrous metal portion of an insert being directly and rigidly connected to the ferrous metal envelope-like supporting structure.

2. A system as set forth in claim 1 wherein the ferrous metal envelope-like supporting structure comprises the hull of a vessel.

3. A system as set forth in claim 1, wherein the cryogenic insulation comprises alternate layers of cryogenic foam insulating material and thin aluminum foil membranes with the portion of the insulation that is adapted to be in direct contact with the tank liquid comprising a thin aluminum foil membrane that serves as the primary liquid containment barrier.

4. A system as set forth in claim 1, wherein the cryogenic liquid holding tank includes corrugated wall portions.

5. A system as set forth in claim 1, wherein the aluminum portion of an insert has a greater width than the ferrous metal portion of an insert.

6. A system for anchoring a cryogenic liquid holding tank of aluminum metal construction to and integrating such tank with an outer envelope-like supporting hull structure of ferrous metal comprising the combination of an aluminum cryogenic liquid holding tank, cryogenic insulation anchored to the interior surfaces of the aluminum cryogenic liquid holding tank, a ferrous metal envelope-like supporting hull structure encompassing in spaced relation at least the major outer surface portions of the aluminum cryogenic liquid holding tank and transition connector means interposed between the tank and hull structure and anchoring the aluminum cryogenic liquid holding tank to and integrating such tank with the ferrous metal envelope-like supporting hull structure to form a composite stress resistant unit, said transition connector means including aluminum stringer elements rigidly and directly connected to the outer surfaces of the aluminum tank and ferrous metal stringer elements rigidly and directly connected to the inner surface of the ferrous metal envelope-like supporting hull structure and said aluminum and ferrous metal elements also being directly and rigidly bonded to each other.

7. A system as set forth in claim 6, wherein an aluminum stringer element is bonded by pressure welding to its associated ferrous metal stringer element.

8. A system as set forth in claim 6, wherein at least certain of the stringer elements are perforated.

9. A system as set forth in claim 6, wherein certain wall portions of the aluminum tank are corrugated.

10. A system as set forth in claim 6, wherein at least certain of the stringer elements are perforated and means are provided for circulating the air in a space between said aluminum tank and said envelope-like supporting hull structure.

11. A system as set forth in claim 6 wherein the aluminum stringer elements have a substantially greater width than the ferrous metal stringer elements and extend across the major portion of the space between the aluminum tank and the ferrous metal hull structure.

12. A system as set forth in claim 6 wherein said ferrous metal hull structure is enclosed within and secured to a further and outermost ferrous metal hull structure.

13. A system as set forth in claim 6, wherein said cryogenic insulation is comprised of alternating layers of cryogenic foam insulating material and thin aluminum foil membranes with the portion of the insulation that is in direct contact with the tank liquid comprising a thin aluminum foil membrane.

14. A system as set forth in claim 6, wherein the transition connector stringer elements comprise composite aluminum and stainless steel inserts pressure welded to a soft aluminum alloy bonding element sandwiched therebetween and said inserts being pressure welded together at a point located closely adjacent the ferrous metal hull structure.

15. A system as set forth in claim 6, including transverse bulkheads interconnected with said aluminum tank said hull structure and said transition connector means, said bulkheads comprising transition inserts made up of aluminum and steel portions pressure welded to each other, and with the aluminum portion of an insert being affixed to another element of aluminum metal and with the ferrous metal portion of an insert being affixed to an element of ferrous metal.

16. A system for anchoring a cryogenic bulk liquid holding tank of aluminum metal construction to and integrating such tank with an outer envelope-like supporting hull structure of ferrous metal comprising the combination of an aluminum cryogenic bulk liquid holding tank, cryogenic insulation anchored to the interior surfaces of the aluminum tank, said insulation comprising alternate layers of relatively rigid closed cell polyurethane foam material and thin aluminum foil membranes with the portion of the insulation that is exposed to and in direct contact with the liquid in the tank being an aluminum foil membrane, a ferrous metal envelope-like supporting hull structure encompassing in spaced relation at least the major outer surface portions of the aluminum liquid holding tank and transition connector means interposed between the tank and hull structure and anchoring the aluminum liquid holding tank to and integrating such tank with the ferrous metal envelope-like supporting hull structure to form a composite stress resistant unit, said transition connector means comprising a plurality of spaced composite stringer elements each of which is made up of an aluminum portion affixed directly and rigidly to said aluminum tank's outer surfaces and a ferrous metal portion affixed directly and rigidly to the inner surface of the ferrous metal envelope-like supporting hull structure and the aluminum and ferrous metal portions of a stringer element also being directly and rigidly bonded to each other.

17. A system as set forth in claim 16, wherein at least certain of the stringer elements are perforated.

18. A system as set forth in claim 16 wherein certain wall portions of the aluminum tank are corrugated.

19. A system as set forth in claim 18, including separate rigid blocks of closed cell polyurethane foam disposed in the recessed portions of the corrugations that open inwardly toward the inside of the tank and forming in conjunction with the corrugations backup and supporting surfaces for a further layer of rigid closed cell polyurethane foam.

20. A system as set forth in claim 16, wherein at least certain of the stringer elements are perforated and means are provided for circulating the air in a space between said aluminum tank and said envelope-like supporting hull structure.

21. A system as set forth in claim 16 wherein the aluminum portion of a stringer element has a substantially greater width than the ferrous metal portion and extends across the major portion of the space between the aluminum tank and the ferrous metal hull structure.

22. A system as set forth in claim 16 wherein said ferrous metal hull structure is enclosed within and secured to a further and outermost ferrous metal hull structure.

23. A system as set forth in claim 16, wherein a stringer element comprises aluminum and stainless steel portions pressure welded to a soft aluminum alloy bonding element sandwiched therebetween and with the pressure welded areas of said aluminum and stainless steel portions being located closely adjacent the ferrous metal hull structure.

* * * * *